US007005061B1

(12) United States Patent
Downs et al.

(10) Patent No.: US 7,005,061 B1
(45) Date of Patent: Feb. 28, 2006

(54) DRAIN FILTER DEVICE

(76) Inventors: Robert Downs, 837 Decatur St. NE., Washington, DC (US) 20017; Mark C. Downs, 837 Decatur St. NE., Washington, DC (US) 20017

( * ) Notice: Subject to any disclaimer, the term of this patent is extended or adjusted under 35 U.S.C. 154(b) by 0 days.

(21) Appl. No.: 10/851,738

(22) Filed: May 24, 2004

(51) Int. Cl.
*E03F 5/06* (2006.01)

(52) U.S. Cl. ..... 210/163; 210/166; 210/474; 210/499; 404/4; 40/292

(58) Field of Classification Search ..... 210/162, 210/163, 164, 166, 170, 474, 499; 404/4, 404/5; 4/292
See application file for complete search history.

(56) References Cited

U.S. PATENT DOCUMENTS 4,035,297 A * 7/1977 Aldridge et al. ..... 210/163
4,321,713 A 3/1982 Thompson
4,419,232 A 12/1983 Arntyr et al.
4,525,273 A * 6/1985 Logsdon ..... 210/164
5,486,287 A 1/1996 Murphy et al.
5,535,554 A * 7/1996 Harris Jr. ..... 210/474
5,733,445 A 3/1998 Fanelli
6,059,964 A * 5/2000 Strawser, Sr. ..... 210/166
6,088,844 A 7/2000 Killham
6,193,880 B1 * 2/2001 Bergeron ..... 210/162
6,214,216 B1 * 4/2001 Isaacson ..... 210/163
6,261,445 B1 7/2001 Singleton
6,706,172 B1 * 3/2004 Strawser, Sr. ..... 210/164
6,808,623 B1 * 10/2004 Harris et al. ..... 404/4

FOREIGN PATENT DOCUMENTS

GB 2102861 * 2/1983
GB 2245918 * 1/1992

* cited by examiner

*Primary Examiner*—Christopher Upton

(57) ABSTRACT

A drain filter device includes a body formed from wire mesh having a plurality of side edge portions integral with each other and forming a substantially square shape. The body further has substantially planar top and bottom surfaces and includes a plurality of elongated support rods having opposed end portions extending along the plurality of side edge portions respectively. The device further includes a top section having a substantially cylindrical shape and connected to the body. The top section is adaptable to be positioned substantially centrally about drain and for filtering out particulate materials suspended in water entering the drain. Advantageously, the top section traps and maintains particulate materials about a perimeter of a drain and not directly above same.

9 Claims, 2 Drawing Sheets

DRAIN FILTER DEVICE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to filtering devices and, more particularly, to a drain filter that prevents the clogging of drains.

2. Prior Art

The present invention pertains to a device for removing particulate matter from a stream of liquid. More particularly, the present invention relates to a wastewater screening device which removes unwanted particulate matter from a wastewater stream. The present invention is particularly, but not exclusively, useful for preventing particulate matter from entering floor drains.

Commercial and residential sinks are typically connected to a wastewater pipe system which eventually empties into a sewer system of some sort. A problem common to sinks and wastewater drain systems is that material can accumulate in the sink, its drain and/or the wastewater piping system which prevents the wastewater from advancing through the system.

The problems associated with clogged sinks and drain systems is particularly acute in commercial restaurant establishments. In these establishments, not only is a large volume of liquid processed through the wastewater system, but typically also a large amount of debris such as food particles, packaging materials, etc., is placed into the wastewater stream. Because of the narrow nature of the sink drain opening and/or the wastewater piping system, these drains and pipes repeatedly become clogged. Once the drain or the piping system becomes clogged, the time-consuming and often costly chore of removing the clog becomes necessary. It has been found that the best way to prevent the clogs, and thus the necessity for removing the clogs, is to prevent material from entering the drain and/or the wastewater piping system.

In the past, a number of devices have been utilized to prevent unwanted material from entering the drain and/or piping system. The oldest and most common method of preventing particulate matter from entering the drain and/or piping system is to place a substantially hemispherical strainer device into the drain of a common sink. The drawbacks of this device are readily apparent.

First, the area through which the wastewater must travel is relatively limited. This results in even a small amount of particulate matter being able to clog the strainer, which in turn results in a back-up in the sink.

Second, once the liquid is backed up, the strainer must be removed by placing one's hand into the backed-up sink to pull the hemispherical-shaped strainer from the drain area. Not only is this an undesirable chore, but the end result is often also equally unacceptable. More specifically, when the dome-shaped strainer is removed from the drain area, the liquid flow rushes around the dome taking the debris collected on the dome down into the drain and into the piping system.

In light of the foregoing, it is an object of the present invention to provide a device for removing particulate matter from a stream of liquid. It is another object of the present invention to provide a straining device for use with residential and commercial sinks, floor sinks and roof drain systems. Still further, it is an object of this invention to provide a straining device having a large straining surface area. Yet another object of this invention is to provide a straining device which can easily be removed from the sink or receptacle in which it is used.

It is yet another object of the present invention to provide a relatively large collection area for the particulate matter such that as the particulate matter builds up and prevents flow through one portion of the screening device, flow is redirected to exit the strainer through another area thereby maximizing flow for a greater period of time. Still further, it is an object of the present invention to provide a device that is relatively easy to manufacture and which is comparatively economical.

BRIEF SUMMARY OF THE INVENTION

In view of the foregoing background, it is therefore an object of the present invention to provide a device for filtering out particulate materials suspended in water traveling towards a drain. These and other objects, features, and advantages of the invention are provided by a drain filter device including a body formed from wire mesh having a plurality of side edges portions integral with each other and forming a substantially square shape. Of course, the present invention may be formed form other suitable material such as plastic, for example; as well known to a person of ordinary skill in the art. The body further has substantially planar top and bottom surfaces and is positionable over a drain for filtering out particulate materials suspended in water traveling towards the drain. The plurality of side edge portions are spaced outwardly and away from a drain.

The device further includes a plurality of elongated support rods having opposed end portions extending along the plurality of side edge portions respectively for maintaining the body in a substantially stable position. The plurality of support rods are disposed about a perimeter of the body for assisting in maintaining surface contact with a surface surrounding a drain so that particulate materials do not travel beneath the top surface. Select ones of the opposed end portions of the support rods are disposed substantially orthogonally to each other. A plurality of fastening members secure the plurality of support rods to the body. Such fastening members may include flexible clips straps about a perimeter of the support rods and passed through the body for securely holding the support rods in place, during inclement weather conditions.

The device further includes a top section having a substantially cylindrical shape and being connected to the body. The top section extends upwardly from the body and is disposed substantially medially between the plurality of support rods. The top section is adaptable to be positioned substantially centrally about a drain for filtering out particulate materials suspended in water entering the drain. Advantageously, the top section traps and maintains particulate materials about a perimeter thereof so that they do not enter and clog a drain.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
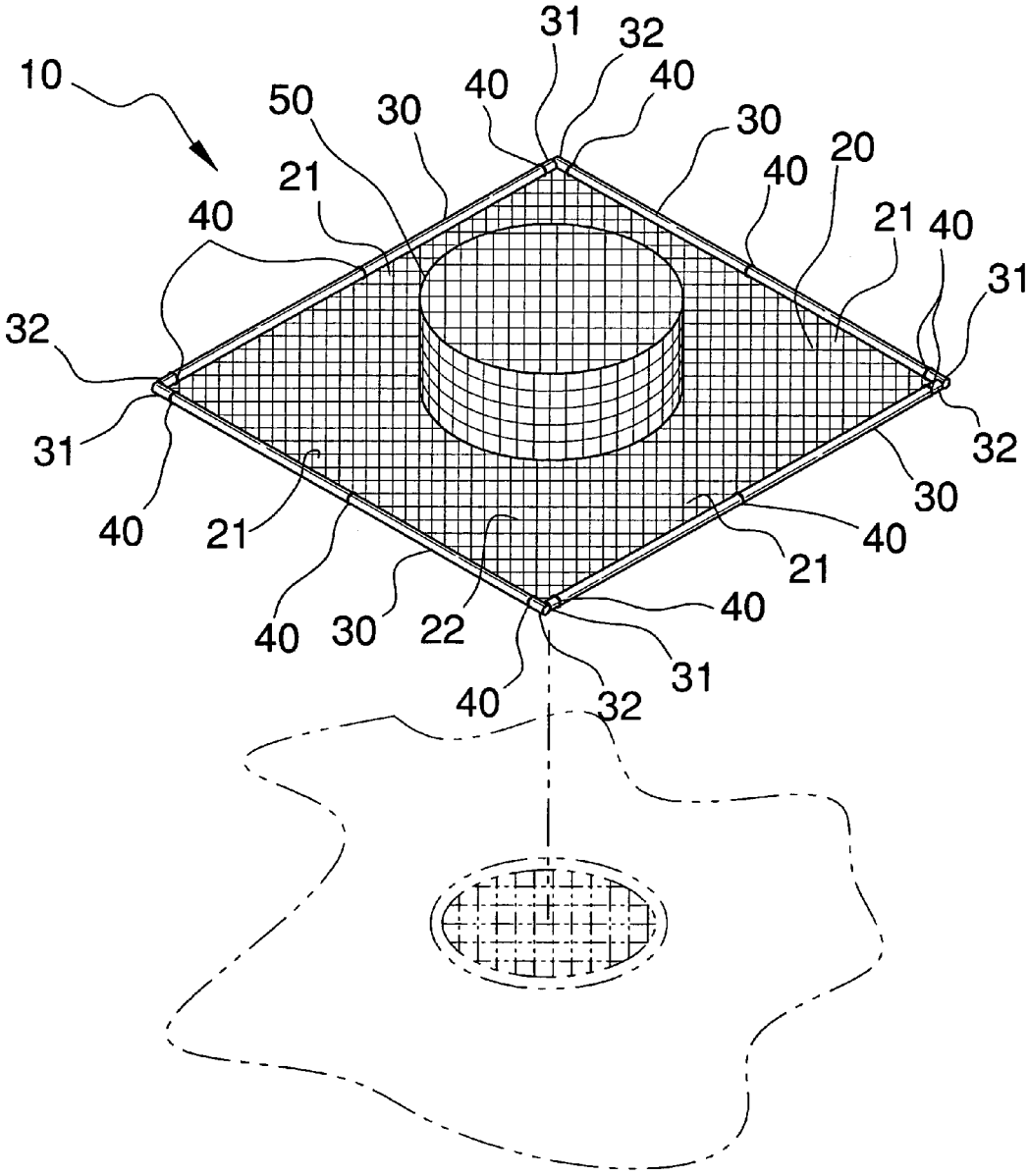
FIG. 1 is a perspective view showing a drain filter in a preferred environment, in accordance with the present invention.
Figure 2:
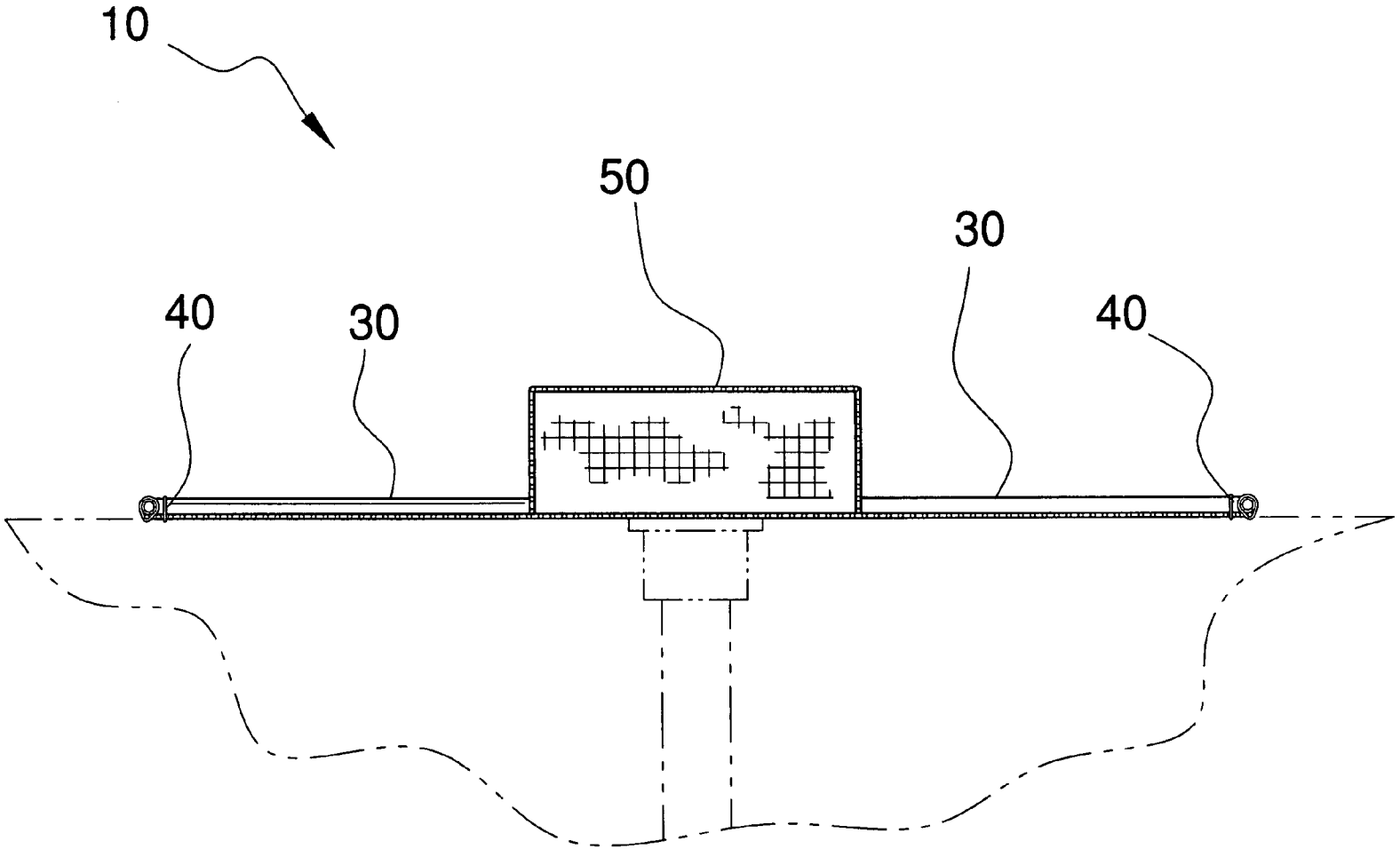
FIG. 2 is a side elevational view of the device shown in FIG. 1.

The apparatus of this invention is referred to generally in FIGS. 1–2 by the reference numeral 10 and is intended to provide a device for filtering out particulate materials suspended in water traveling towards a drain. It should be understood that the device 10 may be used to filter many different types of liquids entering many different types of drains and should not be limited to household drains.

Initially referring to FIG. 1, the device 10 includes a body 20 formed from wire mesh having a plurality of side edges portions 21 integral with each other and forming a substantially square shape. Of course, the present invention 10 may be formed form other suitable material such as plastic, for example, as well known to a person of ordinary skill in the art. The body 20 further has substantially planar top 22 and bottom 23 (not shown) surfaces and is positionable over a drain for filtering out particulate materials suspended in water traveling towards the drain. The plurality of side edge portions 21 are spaced outwardly and away from a drain so that water entering a drain from all directions and within a reasonable distance is filtered.

Still referring to FIG. 1, the device 10 further includes a plurality of elongated support rods 30 having opposed end portions 31, 32 extending along the plurality of side edge portions 21 respectively for maintaining the body 20 in a substantially stable position. The plurality of support rods 30 are disposed about a perimeter of the body 10 for assisting in maintaining surface contact with a surface surrounding a drain so that particulate materials do not travel beneath the top surface, as best shown in FIG. 2.

Select ones of the opposed end portions 31, 32 of the support rods 30 are disposed substantially orthogonally to each other. A plurality of fastening members 40 secure the plurality of support rods 30 to the body 20. Such fastening members 40 are preferably formed from corrosion resistant material to prolong the useful life of the device 10 in a liquid environment. In addition, such fastening members 40 may include flexible clips removably positionable about a perimeter of the support rods 30 and passed through the body 20 for securely holding the support rods 30 in place, during inclement weather conditions.

Still referring to FIG. 1, the device 10 further includes a top section 50 having a substantially cylindrical shape and being connected to the body 20. The top section 50 extends upwardly from the body 20 and is disposed substantially medially between the plurality of support rods 30. This enables a user to easily grasp the device 10 for removal and facilitates cleaning and unclogging of the device 10. The top section 50 is adaptable to be positioned substantially centrally about a drain for filtering out particulate materials suspended in water entering the drain, as best shown in FIG. 2. The top section 50 traps and maintains particulate materials about a perimeter thereof so that they do not enter and clog a drain.

The device 10 is easy and cost-effective method for preventing the clogging of drains and subsequent flooding caused by such clogging. The device 10 is lightweight, compact and convenient to install and remove. The device 10 is also adaptable for use in many different drains, further enhancing its value to a homeowner or businessman seeking to reduce the possibility of damage due to flooding.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation.

The assembly and use of the present invention are deemed readily apparent and obvious to one skilled in the art.

What is claimed as new and what is desired to secure by Letters Patent of the United States is:

1. A drain filter device comprising:

a body having a plurality of side edge portions integral with each other and forming a substantially square shape, said body further having substantially planar top and bottom surfaces and being positionable over a drain for filtering out particulate materials suspended in water traveling towards said drain, said plurality of side edge portions being spaced outwardly and away from a drain;

a plurality of elongated support rods having opposed end portions extending along said plurality of side edge portions respectively and for maintaining said body in a substantially stable position, said plurality of support rods being disposed about a perimeter of said body and for assisting to maintain surface contact with a ground surface surrounding a drain so that particulate materials do not travel beneath said top surface;

a top section having a substantially cylindrical shape and being connected to said body, said top section extending upwardly from said body and being disposed substantially medially between said plurality of support rods, said top section being adaptable to be positioned substantially centrally about a drain and for filtering out particulate materials suspended in water entering said drain, wherein said top section traps and maintains particulate materials about a perimeter thereof; and a plurality of fastening members for securing said plurality of support rods to said body.

2. The device of claim 1, wherein said body is formed from wire mesh.

3. The device of claim 1, wherein select ones of said opposed end portions of said plurality of support rods are disposed substantially orthogonally to each other.

4. The device of claim 1, wherein said top section is formed from wire mesh.

5. A drain filter device comprising:

a body formed from wire mesh and having a plurality of side edge portions integral with each other and forming a substantially square shape, said body further having substantially planar top and bottom surfaces and being positionable over a drain for filtering out particulate materials suspended in water traveling towards said drain, said plurality of side edge portions being spaced outwardly and away from a drain;

a plurality of elongated support rods having opposed end portions extending along said plurality of side edge portions respectively and for maintaining said body in a substantially stable position, said plurality of support rods being disposed about a perimeter of said body and for assisting to maintain surface contact with a ground surface surrounding a drain so that particulate materials do not travel beneath said top surface;

a top section having a substantially cylindrical shape and being connected to said body, said top section extending upwardly from said body and being disposed substantially medially between said plurality of support rods, said top section being adaptable to be positioned substantially centrally about drain and for filtering out particulate materials suspended in water entering said drain, wherein said top section traps and maintains particulate materials about a perimeter thereof; and a plurality of fastening members for securing said plurality of support rods to said body.

6. The device of claim 5, wherein select ones of said opposed end portions of said plurality of support rods are disposed substantially orthogonally to each other.

7. The device of claim 5, wherein said top section is formed from wire mesh.

8. A drain filter device comprising:

a body formed from wire mesh and having a plurality of side edges portions integral with each other and forming a substantially square shape, said body further having substantially planar top and bottom surfaces and being positionable over a drain for filtering out particulate materials suspended in water traveling towards said drain, said plurality of side edge portions being spaced outwardly and away from a drain;

a plurality of elongated support rods having opposed end portions extending along said plurality of side edge portions respectively and for maintaining said body in a substantially stable position, said plurality of support rods being disposed about a perimeter of said body and for assisting to maintain surface contact with a ground surface surrounding a drain so that particulate materials do not travel beneath said top surface, select ones of said opposed end portions of said plurality of support rods being disposed substantially orthogonally to each other;

a top section having a substantially cylindrical shape and being connected to said body, said top section extending upwardly from said body and being disposed substantially medially between said plurality of support rods, said top section being adaptable to be positioned substantially centrally about drain and for filtering out particulate materials suspended in water entering said drain, wherein said top section traps and maintains particulate materials about a perimeter thereof; and a plurality of fastening members for securing said plurality of support rods to said body.

9. The device of claim 8, wherein said top section is formed from wire mesh.

* * * * *